US005544374A

United States Patent [19]

Strobel

[11] Patent Number: 5,544,374

[45] Date of Patent: Aug. 13, 1996

[54] LEG SYSTEM FOR BEDS

[76] Inventor: Mark J. Strobel, 3131 Industrial Pkwy., Jeffersonville, Ind. 47130

[21] Appl. No.: 402,905

[22] Filed: Mar. 13, 1995

[51] Int. Cl.[6] ..... A47C 19/02

[52] U.S. Cl. ..... 5/310; 5/201; 5/285; 5/400; 5/203; 5/305; 108/56.3; 108/157

[58] Field of Search ..... 5/200.1, 201, 400, 5/310, 203, 285, 305, 308; 108/56.3, 157

[56] References Cited

U.S. PATENT DOCUMENTS

| | | | |
|---|---|---|---|
| 948,416 | 2/1910 | Deweese | 5/305 |
| 2,093,164 | 9/1937 | DeBoer | 5/200.1 X |
| 2,484,969 | 10/1949 | Stacy | 5/310 |
| 3,973,281 | 8/1976 | Davis et al. | 5/310 X |
| 4,675,929 | 6/1987 | Santo | 5/285 X |
| 4,734,946 | 4/1983 | Saputo | 5/285 X |
| 4,850,284 | 7/1989 | DeGroot et al. | 108/56.3 X |
| 5,195,440 | 3/1993 | Gottlieb | 108/56.3 X |
| 5,289,600 | 3/1994 | Schermel | 5/201 X |
| 5,477,571 | 12/1995 | Rossenkamp et al. | 5/310 |

*Primary Examiner*—Michael F. Trettel
*Attorney, Agent, or Firm*—James B. Middleton

[57] ABSTRACT

A leg set for a bed is provided by lengths of tubular material having ends at right angles to the centerline of the tube. The upper end of the tube length is notched so the vertically oriented supports for the bed can be slipped into the notches. The notches are deep enough, and the diameter of the tube is sufficient, to provide lateral stability. The vertically oriented supports may be the structural members of the box for a soft sided waterbed, may be supports for the deck of a full flotation waterbed, or may be a support for any other form of mattress.

11 Claims, 2 Drawing Sheets

LEG SYSTEM FOR BEDS

BACKGROUND OF THE INVENTION

1. Field of the Invention

This invention relates generally to supporting means, and is more particularly concerned with a leg set, or pedestal, for a bed.

2. Background of the Invention

In considering supporting means for beds, beds are generally broken down into two broad classifications: waterbeds, and conventional beds.

There are two general types of waterbed: the full flotation waterbed, which includes a water mattress, and a frame around the mattress to retain the desired shape; and, the soft side waterbed, which has a smaller fill height than the full flotation mattress, and includes flexible foam rails to hold the shape of the mattress. The soft side may also have pads above and/or below the water mattress. For both types of waterbed, the mattress is supported on a platform of some sort, and the platform is usually (though not always) supported above the floor by legs, a pedestal or the like.

The full flotation waterbed generally comprises a pedestal supporting a deck, the water mattress and frame then being carried on the deck. The soft side waterbed may utilize a pedestal similar to that of a full flotation water bed, but it frequently includes a box to simulate the appearance of a box spring for a conventional bed. The box may then be supported on a metal frame with legs, similar to the frame of a conventional bed.

There have been some efforts at providing a leg set for a waterbed, but the prior art leg sets have required either that the legs bolt into the foundation, or that the legs screw into specially provided metal plates. In either case, the legs become expensive, difficult and time consuming. Legs for conventional beds are fixed to the usual metal frame, or are integral parts of a bedstead.

In view of the above discussion it will be understood that supports for beds have been largely the same for many years. Standard lumber has changed to a thinner particle board, and screws and brackets have changed to plastic extrusions for attaching corners, but the basic support has remained the same. This is true even though the existing pedestals for waterbeds tend to be about the same height; and, to increase the height causes a large increase in price because of the amount of material required. As a result, the consumer has little choice in bed supports, and cannot vary even the height of the support without an extremely large increase in price.

SUMMARY OF THE INVENTION

The present invention provides a leg set for a bed, the leg set comprising a plurality of legs having notches for receiving horizontal supports for the bed. The horizontal supports may be an integral part of the mattress support, or may be additional members used to create a mattress support.

In one embodiment of the invention, for a soft side waterbed, the box for supporting the mattress has horizontal members that are received in notches in the legs of the present invention, so the legs of the present invention are directly fixed to the existing bed. In another embodiment, for a full flotation waterbed or a conventional bed, separate horizontal members have notches complementary to notches in the legs, so the legs with the horizontal members make up a pedestal to receive a conventional bed of any desired type.

The present invention therefore provides a very simple leg set for a bed, the height being easily variable simply by using longer or shorter legs. The number of legs can be varied depending on the support needed, and the number of horizontal members can also be varied to provide the desired strength and stability.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
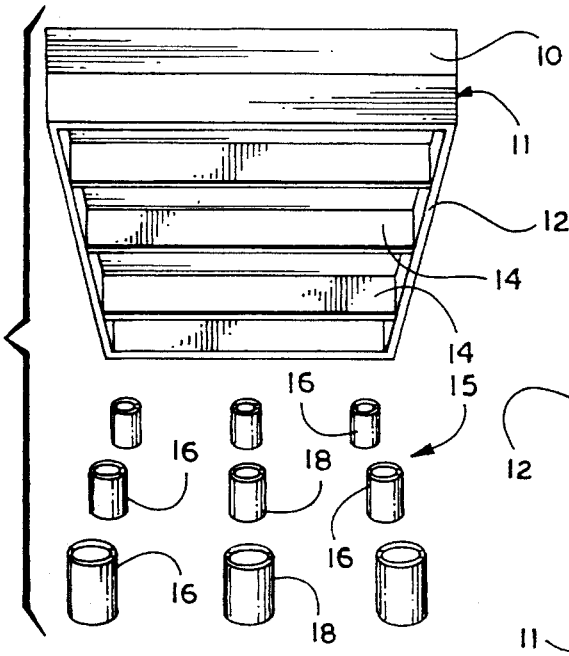
FIG. 1 is an exploded perspective view showing a leg set made in accordance with the present invention in conjunction with a soft side waterbed.

Referring now more particularly to the drawings, and to those embodiments of the invention here presented by way of illustration, FIG. 1 represents a soft sided waterbed including the rails 10 which form part of the mattress structure, and a box 11 which supports the mattress and simulates a box spring in a conventional bed. It is common for the box 11 to consist of an outer skirt 12 with internal cross-pieces 14 to lend the additional strength needed to support the mattress. The number of cross-pieces 14 may of course vary depending on the size of the bed, the strength of the materials used, and the total load for which the bed is designed.

A leg set 15 is shown exploded from the box 11. The leg set here illustrated will be sufficient for most soft-sided waterbeds, but the present invention includes the use of a greater number of individual legs to withstand greater loads, and the use of a smaller number of legs for lighter loads.

The leg set 15 of the present invention comprises a plurality of individual legs, each individual leg consisting of a tubular member defining a plurality of notches in its upper end for receiving the supports for the waterbed support. In the example illustrated in FIG. 1, there are three legs to be received on each of the cross pieces 14. It is contemplated that the outer legs 16 will be recessed somewhat from the skirt 12, while the center legs will be generally centered on the cross pieces 14.

With the box 11 and the leg set 15 as described above, it will be understood that the notches in the legs of the leg set 15 comprise two notches 180° apart, so the notches will receive portions of the cross-pieces 14, the notches being deep enough, in conjunction with the diameter of the tubular members, that sufficient lateral stability will be provided. Thus, the legs 16 and 18 may be simply slipped onto the box 11, and the support is in place.

Figure 2:
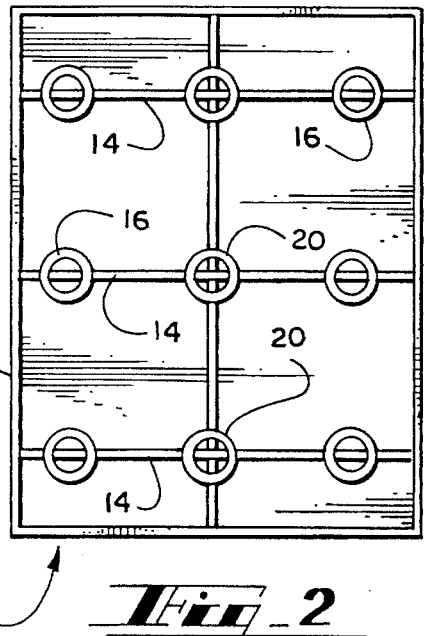
FIG. 2 is a bottom plan view showing a leg set like that shown in FIG. 1, in place on a bed having a different support arrangement.

FIG. 2 shows a bed similar to that of FIG. 1, but there is a longitudinal support 19. As a result, the legs 20 are notched to receive both the cross pieces 14 and the longitudinal support 19.

Figure 3:
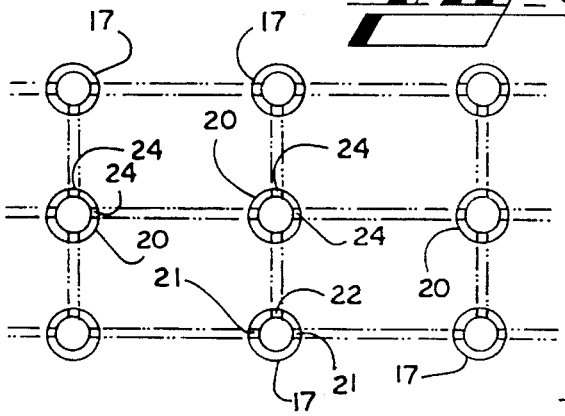
FIG. 3 is a top plan view showing a leg set like that shown in FIG. 1, with connecting members shown in phantom.

Looking at FIG. 3 of the drawings, the distinctions between different forms of legs is shown. The support members are shown in phantom; and, for purposes of the present discussion these members may be taken as representing the cross-pieces 14 of FIG. 1 and longitudinal supports such as the support 19. The legs 17 are at the edges, so the legs 17 have notches 21 placed at 180° apart, and a notch 22 between these two. The legs 20 are at the intersection of the cross-pieces 14 and the longitudinal support 19, so they have two sets of notches 24 at 180° apart, which results in four notches spaced 90° apart.

Figure 4:
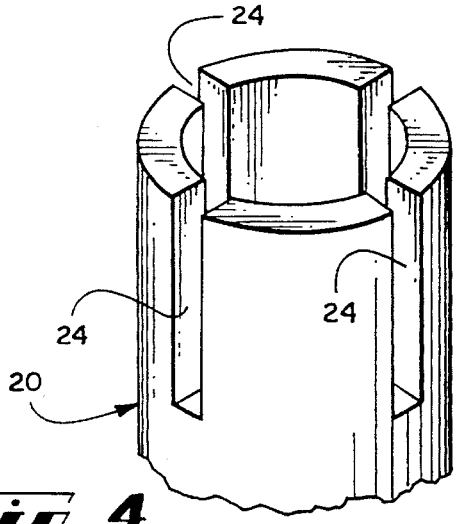
FIG. 4 is an enlarged, fragmentary perspective view showing the upper end of one leg made in accordance with the present invention.

FIG. 4 shows the upper portion of a leg in more detail. For purposes of illustration the leg 20 is shown because it has four notches here designated at 24. In FIG. 4 it can be seen that the leg 20 is formed from a tube having a relatively thick wall. The thickness of the wall must be such as to yield the strength required, and this of course varies with the specific material used. Some legs have been tested using tubes of compacted paper, the tubes being around 3 inches (7.5 cm.) in diameter, with a wall thickness around ⅜ inch (1 cm.). Another material that appears to be satisfactory is a tube of polystyrene, the tube having a diameter of around 3 inches (7.5 cm.) and a wall thickness of about ¼ inch (0.5 cm). Thus, a tube of steel, aluminum or the like may have a wall thickness of only a few millimeters, and tubes of softer resins, papers and the like may have a wall thickness above one centimeter. Those skilled in the art can readily determine the particular combination of characteristics required.

In FIG. 4 it will be seen that the notches 24 are placed along diameters of the tube, the four notches being on diameters that are 90° apart. Each of the notches 24 is the same depth so all four notches will equally receive the weight placed on the leg 20. For soft-side beds as shown in FIG. 1, the notches 24 may be about 2 inches (5 cm) deep. By using a tubular member, or leg, 9.25" (23.5 cm) long, the 2 inch (5 cm) deep notches place the foundation 7.25" (18.5 cm) off the floor, which is the conventional height achieved by conventional metal frames used for such beds.

Figure 5:
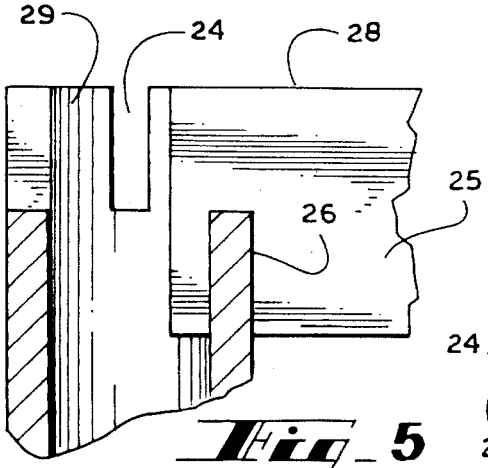
FIG. 5 is a fragmentary, diametrical cross-sectional view showing a leg made in accordance with the present invention having a horizontal member, or stringer, attached thereto.

Looking next at FIG. 5 of the drawings, it will be see that the legs discussed above can be used in other arrangements. FIG. 5 illustrates the creation of a support, for example for a full flotation waterbed, using legs such as the leg 20. A plurality of stringers 25 can be fixed to a leg set such as the leg set 15 in FIG. 1. Also, in FIG. 3, the showing in phantom may represent a plurality of stringers 25.

The stringer 25 has a notch 26 preferably around half way through the width of the stringer 25. As shown in FIG. 5, the notch 26 is close to the end of the stringer 25 to form a hook. This hook is engaged with the leg 20 by interengaging the notch 26 in the stringer with a notch 24 in the leg 20. The dimensions are so arranged that the upper edge 28 of the stringer 25 is level with the upper surface 29 of the leg 20.

With the above discussion in mind, and looking at FIG. 3 of the drawings, it will be realized that a plurality of stringers 25 can be used to connect a leg set for creating of a pedestal for a full flotation waterbed or virtually any other bed. It will of course be understood that the stringers 25 may have notches 26 at each end, with each stringer 25 extending between two adjacent legs. Alternatively, a single stringer may span three or more legs, with appropriate notches for engaging the intermediate legs. A pedestal so formed can then receive a deck for a waterbed or other bed, and the height of the pedestal can be readily varied by varying the length of the legs.

Figure 6:
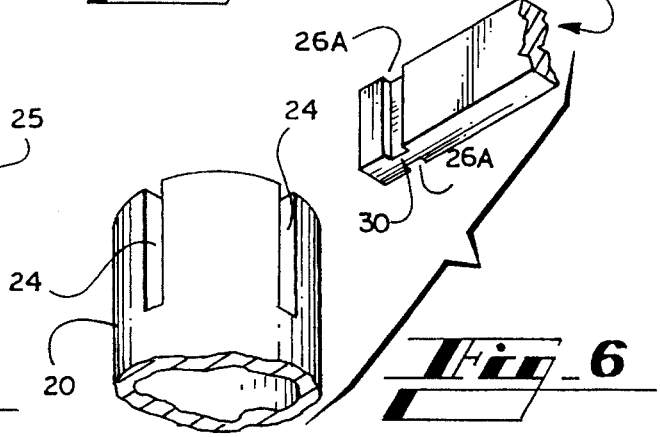
FIG. 6 is a fragmentary, perspective, exploded view illustrating a different connecting means between the leg and the stringer.

FIG. 6 of the drawings shows a modification of the stringer shown in FIG. 5. The stringer 25A in FIG. 6 has notches in the form of opposed grooves 26A. The thickness of the web 30 will be approximately the width of the notch 24 in the leg 20, and the width of the notches 26A will be approximately the wall thickness of the leg 20. Thus, the edges of the grooves 26A will act as shoulders to prevent rotation of the stringer 25A with respect to the leg 20.

Figure 7:
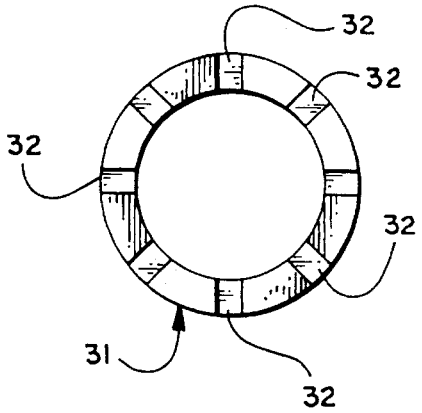
FIG. 7 is a top plan view of a modified form of leg.

Looking at FIG. 7 of the drawings, a modified form of leg is shown. The leg 31 in FIG. 7 has eight notches 32, the notches 32 being equally spaced around the circumference of the leg 31, so the notches are 45° apart. The purpose of the additional notches is to allow angled stringers for additional strength, and to assist in bringing the pedestal into the proper shape, as illustrated in FIG. 8.

Figure 8:
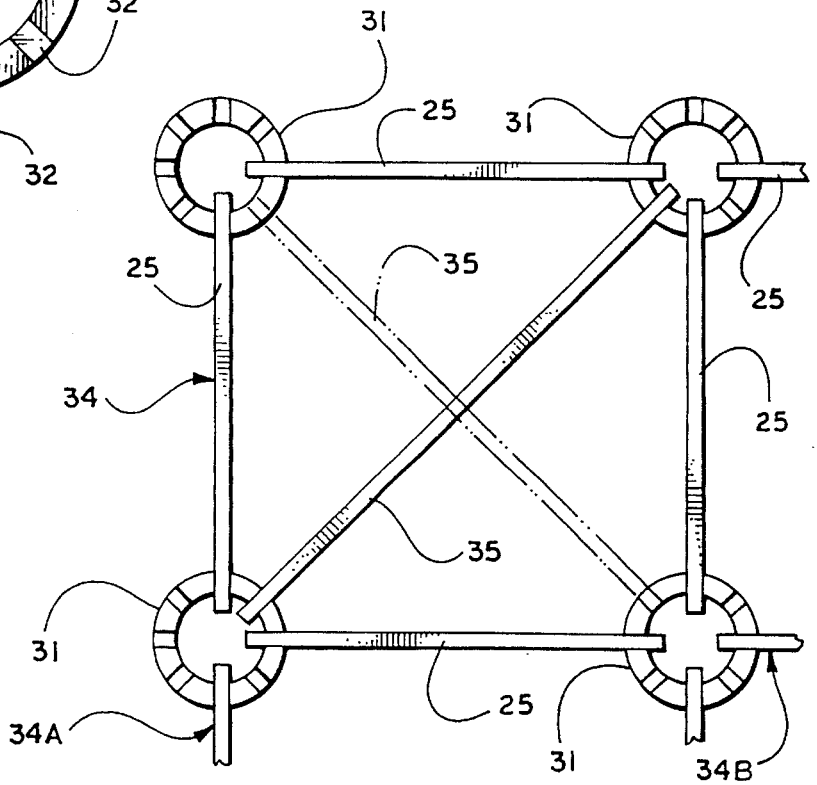
FIG. 8 is a top plan view of a portion of a bed support using the leg of FIG. 7; and, FIG. 9 is a view similar to FIG. 5 showing a modified bed support structure.

FIG. 8 shows a portion of a pedestal for a bed, only four legs 31 being shown. One technique for use of the legs 31, therefore, is to utilize stringers such as the stringers 25, all stringers being of the same length so a plurality of contiguous squares 34 can be formed. In addition, one would use at least one diagonal 35. With the stringers 25 and diagonal 35 of the proper lengths, it will be understood that the figure formed must be square, because this fixes the lengths of three sides of a triangle. With one portion (such as that shown in FIG. 8) square, other, contiguous arrangements 34A and 34B, shown fragmentarily in FIG. 8, must also have square corners. It will be recognized that rectangles of various proportions can be similarly formed by providing stringers (sides of a triangle) and diagonals (hypotenuse of a triangle) of the desired lengths.

As indicated in phantom in FIG. 8, two diagonals 35 may be used in any of the squares, though of course the center of the diagonals 35 must be notched for the intersection of the two diagonals. Thus, it will be seen that the leg 31 will accommodate the stringers 25, as well as the diagonals 35. For a leg 31 at the intersection of stringers 25, and with all diagonals 35 in place, it will be understood that all eight of the notches 32 will be required. Those skilled in the art will understand that, for legs placed otherwise, fewer notches 32 can be provided in accordance with the discussion related to FIGS. 1, 2 and 3.

Figure 9:
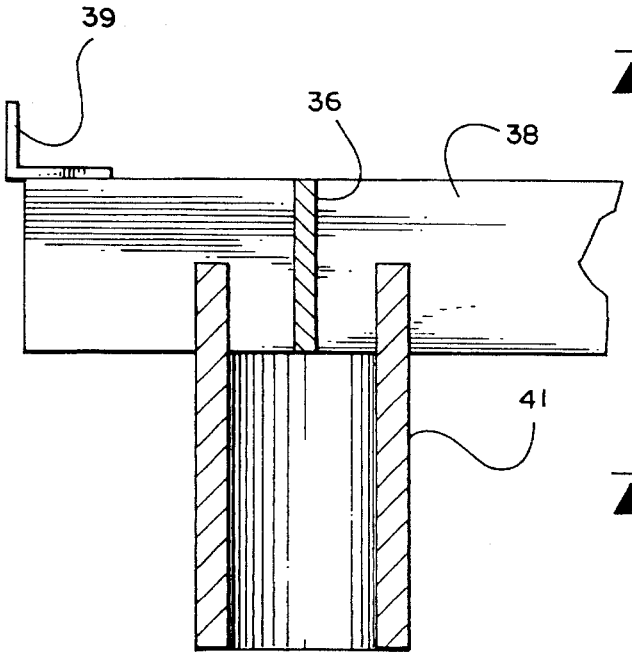

In accordance with the foregoing discussion, a pedestal for a bed can be formed by a plurality of legs making up a leg set such as the leg set 15, and a plurality of stringers 25, with or without one or more diagonals such as the diagonal 35. FIG. 9 illustrates a slight modification of such structure, a support being made by a plurality of transverse and longitudinal members 36 and 38. Those skilled in the art will understand that a deck, box springs or the like may then be received on the support, and a stop 39 is provided to prevent inadvertent lateral motion of the deck, springs etc. Legs such as those shown and described with respect to FIG. 3 can then be placed on the support. The legs, such as the leg 40, can be placed wherever needed, and can be notched as required for the particular location. If a leg 40 is to be placed simply on one member 36 or 38, only two notches 180° apart will be required. Other arrangements may be as previously discussed.

It can also be clearly seen in FIG. 9 that the leg 40 is cut flat at its lower end, or perpendicular to the center line of the tubular leg. All legs discussed above will be similarly formed so the legs will stand vertically.

While the legs shown in the drawings are circular in cross-section, it will be recognized that other shapes may be used, and will work as well. For an arrangement such as that shown in FIGS. 1 and 2, a square or other polygon would be equally satisfactory. For the arrangement shown in FIGS. 7 and 8, an octagon could be used.

It will therefore be understood by those skilled in the art that the specific embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A leg set for a bed including support means, said support means including a plurality of stringers having at least one portion of a given width, said leg set comprising a plurality of tubular members, each tubular member of said plurality of tubular members having a lower end perpendicular to the centerline of said tubular member, and an upper end defining a plurality of notches therein, each notch of said plurality of notches having a width approximately equal to said width of said stringers for snugly receiving said stringers therein so that said tubular members receive said stringers and extend downwardly for supporting said bed.

2. A leg set as claimed in claim 1, wherein said notches in said upper end of said tubular members have a depth less than the height of said stringers.

3. A leg set as claimed in claim 1 wherein said bed includes a box for supporting a mattress thereon, said plurality of stringers constituting supports for said box, and wherein said leg set comprises a first group of tubular members and a second group of tubular members, said notches on the upper end of said first group of tubular members comprising at least two notches located 180° apart, said notches on said second group comprising at least three notches positioned 90° from one another.

4. A leg set as claimed in claim 1, wherein each stringer of said plurality of stringers defines a notch in the ends thereof, said notch in said stringer being receivable within said notches on the upper end of said tubular members.

5. A leg set as claimed in claim 4, wherein said notches in said upper end of said tubular member have a depth approximately equal to the height of said stringers.

6. A leg set as claimed in claim 4, wherein said notches in said upper ends of said tubular members have a depth equal to one-half the height of said stringers.

7. In a bed including a mattress, and a support for said mattress, said support for said mattress including a plurality of stringers having a given width, said stringers extending longitudinally and transversely of said mattress, the combination therewith of a leg set for supporting said stringers above a supporting surface, said leg set comprising a plurality of tubular members, each tubular member of said plurality of tubular members defining a plurality of notches in the upper end thereof, each notch of said plurality of notches having a width substantially equal to the width of said stringers for snugly receiving one of said stringers therein.

8. In the combination as claimed in claim 7, said bed comprising a soft sided waterbed, said support comprising platform means for supporting said mattress, said stringers constituting cross-pieces for said platform means.

9. In the combination as claimed in claim 7, wherein said plurality of stringers constitute a pedestal for said bed, each stringer of said plurality of stringers is of the same length, and including connecting means on each end of each of said stringers for selectively connecting said stringers to said tubular members.

10. In the combination as claimed in claim 9, said pedestal further including at least one diagonal, said diagonal including connecting means for connecting said diagonal to said tubular members.

11. In the combination as claimed in claim 9, said support further including stop means fixed with respect to at least some of said stringers for preventing horizontal motion of said mattress with respect to said support.

* * * * *